US007396180B2

(12) United States Patent
Bugla et al.

(10) Patent No.: US 7,396,180 B2
(45) Date of Patent: Jul. 8, 2008

(54) APPLICATOR DEVICE

(75) Inventors: Manfred Bugla, Forchheim (DE); Rainer Gaebler, Erlangen (DE); Susanne Emig, Eckental (DE); Dieter Schiller, Rosstal (DE)

(73) Assignee: Schwan-Stabilo Cosmetics GmbH & Co. KG, Heroldsberg (DE)

( * ) Notice: Subject to any disclaimer, the term of this patent is extended or adjusted under 35 U.S.C. 154(b) by 302 days.

(21) Appl. No.: 11/144,136

(22) Filed: Jun. 2, 2005

(65) Prior Publication Data

US 2005/0281609 A1 Dec. 22, 2005

(30) Foreign Application Priority Data

Jun. 4, 2004 (EP) ..... 04013254

(51) Int. Cl.
*B43K 1/06* (2006.01)

(52) U.S. Cl. ..... 401/265; 401/263

(58) Field of Classification Search ..... 401/280, 401/281, 186, 205, 263, 265; 222/491, 492, 222/495, 497, 207, 211, 212, 213
See application file for complete search history.

(56) References Cited

U.S. PATENT DOCUMENTS

| | | | | |
|---|---|---|---|---|
| 2,715,236 | A | 8/1955 | Tereno | |
| 3,493,179 | A * | 2/1970 | Hsuen | 239/327 |
| 4,203,536 | A * | 5/1980 | Lester | 222/495 |
| 4,253,588 | A * | 3/1981 | Lester et al. | 222/153.14 |
| 4,673,110 | A * | 6/1987 | Workum | 222/211 |
| 4,674,659 | A | 6/1987 | Micallef | |
| 5,772,347 | A | 6/1998 | Gueret | |
| 5,803,314 | A * | 9/1998 | Lester | 222/153.14 |
| 5,860,571 | A | 1/1999 | Gueret | |
| 6,152,328 | A | 11/2000 | Gueret | |
| 6,415,961 | B2 * | 7/2002 | Bonningue | 222/249 |
| 2003/0075200 | A1 | 4/2003 | Gueret | |

FOREIGN PATENT DOCUMENTS

| | | |
|---|---|---|
| FR | 1.260.812 | 4/1961 |
| WO | WO 01/76972 | 10/2001 |

* cited by examiner

*Primary Examiner*—David J Walczak
(74) *Attorney, Agent, or Firm*—Bachman & LaPointe, P.C.

(57) ABSTRACT

An applicator device for a fluid, gel-like, pasty or powder product comprising a storage compartment in which the product is accommodated in free form, and an outlet for the product. A barrier is provided which in at least one operating condition at least partially blocks a straight path for the product from the storage compartment to the outlet.

6 Claims, 1 Drawing Sheet

APPLICATOR DEVICE

BACKGROUND OF THE INVENTION

The invention concerns an applicator device for a fluid, gel-like, pasty or powder product, in particular a cosmetic product, comprising a storage means in which the product is accommodated in free form, and an outlet for the product.

Applicator devices of the above-indicated kind are known. Particularly when the product is in fluid (low-viscosity) form but also in the case of gel-like, pasty and powder products, it has frequently been observed in relation to conventional applicator devices that the result of the applicator device being shaken, as occurs in particular when it is being transported from the manufacturer to the shop, is that the product passes from the storage means to the outlet and through the outlet. In particular those amounts of the product which pass through the outlet are then wasted in terms of the subsequent (appropriate) use. In addition they contaminate the applicator device.

However, the fact of the applicator device being shaken when being carried around in a handbag or the like, that is to say in the course of everyday activity, can also represent a problem. More specifically the result of the applicator device being shaken in that fashion can also be that product issues from the outlet.

Therefore the object of the present invention is to develop the applicator device of the kind set forth in the opening part of this specification in such a way that it is better protected from the detrimental consequences of being shaken.

SUMMARY OF THE INVENTION

According to the invention that object is attained by a barrier which in at least one operating condition at least partially blocks a straight path for the product from the storage means to the outlet.

As, in accordance with the invention, the straight path from the storage means to the outlet is at least partially blocked, the product is required to virtually make a 'detour' in order to go from the storage means to the outlet. In the case of the device being shaken however the product is usually moved only in one direction. Therefore shaking cannot generally mean that the product takes the 'detour'. Rather, in a case of the applicator device being shaken, the product will only encounter the barrier or press against the barrier without finding the way to the outlet. In other words, the barrier provides for a deflection of the material and a concomitant inhibition of the flow of material in the case of the device being shaken, for example by virtue of being dropped.

The increase in flow speed in use, which the barrier entails, that is to say when the product takes the 'detour', and the friction against the walls which deflect the flow, also produce an intensive turbulence effect and thus mixing of the product, by means of which it is possible to counteract any tendency on the part of the product to separate, that may occur.

In accordance with a preferred embodiment of the invention it is provided that the barrier can assume at least two operating conditions, namely a first operating condition in which it blocks a path for the product from the storage means to the outlet to a first extent and a second operating condition in which it blocks the path to a second extent which is less than the first extent.

Such a design configuration affords the possibility of achieving a particularly high degree of safeguard against the product (accidentally) issuing through the outlet, for example for transport from the manufacturer to the shop, by setting the first operating condition. In comparison, the second operating condition with a somewhat lesser degree of safeguard against the product issuing from the outlet can be appropriate for everyday life.

In that respect, in accordance with the invention, it can be particularly provided that the barrier completely blocks the path in the first operating condition. That affords absolute security against the product issuing from the outlet for example during transport from the manufacturer to the shop.

In accordance with the invention the barrier is preferably displaceable from the first into the second operating condition but not vice-versa. In other words the displacement is irreversible. Such irreversibility can be useful in particular when the barrier completely blocks the path for the product from the storage means to the outlet in the first operating condition. More specifically it protects against malfunctions.

Preferably in accordance with the invention the barrier has a wall transversely with respect to the straight path and a passage transversely with respect to the wall.

That embodiment is particularly simple to produce.

In that respect it can be provided that the passage is closed in the first operating condition and at least partially open in the second operating condition. Once again that embodiment is to be viewed as being particularly simple to produce.

In accordance with a particularly preferred embodiment of the invention the barrier has a pot-shaped device. Devices of that kind are particularly simple to manufacture.

An embodiment of the invention which is preferred as being particularly simple to handle provides that the barrier is displaceable with respect to the storage means and/or with respect to the outlet.

In accordance with a particularly preferred embodiment of the invention it is provided that the barrier is slidable in the direction of the path for the product from the storage means to the outlet.

The stated direction of sliding movement generally involves the longitudinal direction of an applicator device in the form of a pencil. In such a case the displaceability of the barrier, in accordance with the invention, does not require any increase in the dimensions of the pencil in the direction of the thickness.

Finally, it is preferably provided in accordance with the invention that the barrier is responsive to an increase in the pressure in the storage means in the direction of displacement from the first operating condition into the second operating condition.

That design configuration virtually provides an automatic arrangement because usually conveying movement of the product from the storage means to the passage involves an increase in the pressure in the storage means. This therefore provides for automatic displacement of the barrier from the first operating condition into the second operating condition when the applicator device is merely used in the usual fashion.

BRIEF DESCRIPTION OF THE DRAWINGS

The invention is described in greater detail hereinafter by means of a preferred embodiment by way of example with reference to the accompanying drawing in which.

DETAILED DESCRIPTION

Figure 1:
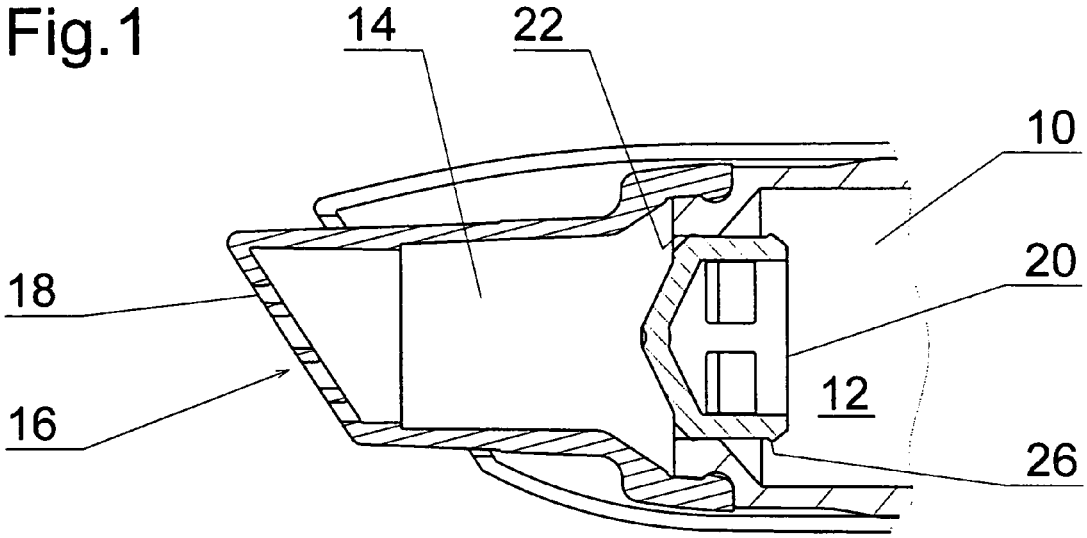
FIG. 1 is a diagrammatic view in longitudinal section on an enlarged scale of an applicator device for cosmetic products in accordance with a particularly preferred embodiment of the invention in a first operating condition.

The applicator device illustrated in the drawing includes a storage means 10 in which a fluid cosmetic product such as for example red lipstick 12 is accommodated. The storage means 10 is connected by way of a conveyor passage 14 to a working surface 16 of an applicator tip. Provided in the working surface 16 are outlets of which one is denoted by way of example by reference numeral 18.

In the operating condition shown in FIG. 1 (first operating condition) the storage means 10 is closed on its side that is towards the working surface 16 by a plug 20 which fits in an opening 22. A sealing ridge 24 which in the first operating condition bears in sealing relationship against the inside wall of the opening 22 serves for sealing integrity. In the first operating condition shown in FIG. 1 the plug 20 sealingly closes the storage means 10 so that, even in the case of the applicator device being shaken, the red lipstick 12 cannot pass to the outlet 18 at the working surface 16.

Figure 2:
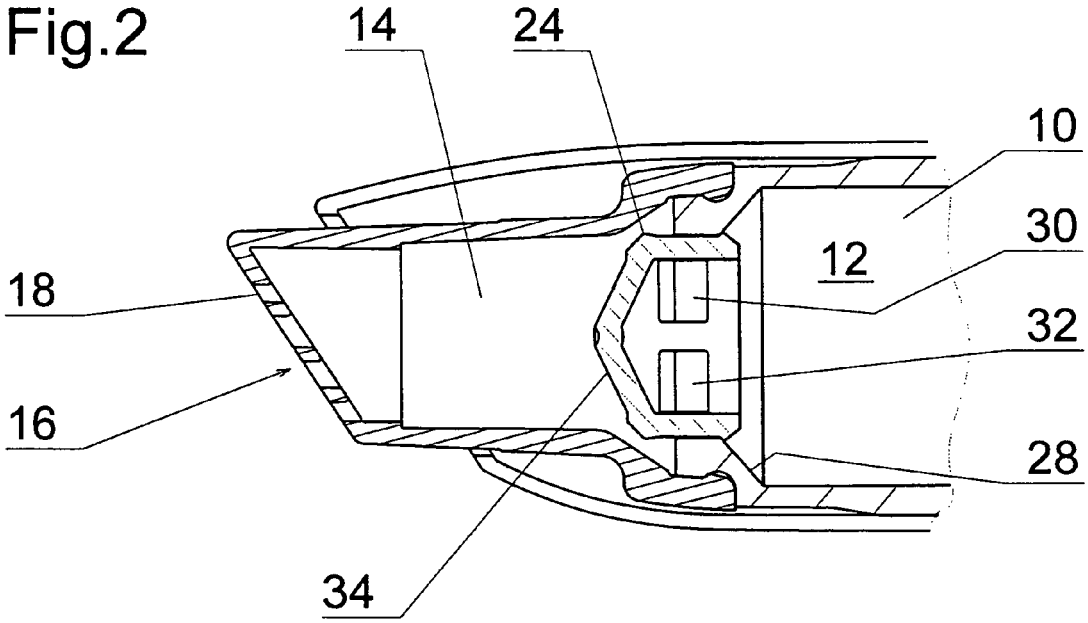
FIG. 2 shows the applicator device of FIG. 1 but in a second operating condition.

In the second operating condition as shown in FIG. 2 the plug 20 is displaced in a direction towards the working surface 16 in relation to the first operating condition shown in FIG. 1. The displacement is limited by a peripherally extending nose 26 abutting against a step 28.

In the second operating condition (FIG. 2) the plug 20 no longer seals off the storage means 10. More specifically the plug 20 has passages 30, 32 which, in the second operating condition, open a path for the lipstick 12 from the storage means 10 through the conveyor passage 14 to the outlet 18. That is the case for the reason that, in the second operating condition, the passages 30, 32 only still partially overlap with the opening 22, but in comparison project partially beyond the opening 22.

In the second operating condition the lipstick 12 makes a 'detour' on its path from the storage means 10 to the outlet 18, namely through the passages 30, 32. That detour involves an increase in the flow speed and friction against the walls of the plug 20, which results in intensive swirl and thus mixing of the material (lipstick) which otherwise tends to separate.

The lipstick 12 is conveyed out of the storage means 10 by way of the conveyor passage 14 to the working surface 16 with the outlets 18 as a consequence of pressure in the storage means 10. When the plug 20 is in the first operating condition (FIG. 1), such a pressure initially does not cause any conveying movement of lipstick 12 but rather causes a displacement of the plug 20 out of the first operating condition shown in FIG. 1 into the second operating condition shown in FIG. 2. Such a build-up of pressure takes place for example due to actuation of a rotary mechanism (not shown), more specifically this generally already taking place during the so-called initial rotation, that is to say during the movement for overcoming any dead spaces in the storage means 10, which are not filled with lipstick 12. Once the plug 20 has reached the second operating condition (FIG. 2), even the production of a reduced pressure in the storage means 10, because of the presence of the passages 30, 32, no longer results in the plug 20 moving back into the first operating condition (FIG. 1). In other words, displacement of the plug 20 from the first operating condition (FIG. 1) into the second operating condition (FIG. 2) is irreversible.

Although the passages 30, 32 allow the lipstick 12 to be conveyed out of the storage means 10 towards the outlets 18 in the second operating condition (FIG. 2), the bottom 34 of the plug 20 which is of a pot-shaped configuration affords sufficient protection against accidental conveying of lipstick material out of the storage means 10 to the outlets 18 as a consequence of the applicator device being shaken. More specifically shaking can generally only trigger linear movements but not movements which make a 'detour' around the bottom 34 of the pot shape, through the passages 30, 32. Accordingly, in both illustrated operating conditions, the plug 20 represents effective protection against discharge under the effect of shaking.

The features of the invention disclosed in the foregoing description, the claims and the drawing can be essential both individually and also in any combinations for implementing the invention in the various embodiments thereof.

The invention claimed is:

1. An applicator device for a fluid, gel-like, pasty or powder product comprising a storage means in which the product is accommodated in free form, an applicator tip, said applicator tip having a first portion defining a conveyor passage and a second portion at least part of which defines a working surface;

a plurality of outlets in the second portion of the applicator tip said plurality of outlets communicate with the conveyor passage and with the working surface; and a barrier between the storage means and the working surface, the barrier being movable relative to both the storage means and the working surface from a first position wherein the barrier blocks a path extending along a longitudinal axis of the applicator for the product from the storage means to the plurality of outlets to a second position wherein the path is unblocked wherein product is fed to the working surface of the applicator tip, wherein the barrier has a wall which extends transversely with respect to the path and a passage which extends through a wall which depends from the transversely extending wall, wherein the product is able to pass transversely to the longitudinal axis of the applicator through the passage.

2. An applicator device according to claim 1 wherein the barrier completely blocks the path in the first position.

3. An applicator device according to claim 1 wherein the passage is closed in the first position and at least partially open in the second position.

4. An applicator device according to claim 1 wherein the barrier comprises a pot-shaped device.

5. An applicator device according to claim 1 wherein the barrier is slidable in the direction of the path for the product from the storage means to the plurality of outlets.

6. An applicator device according to claim 1 wherein the barrier is responsive to an increase in the pressure in the storage means in the direction of the working surface from the first position to the second position.

* * * * *